US010032328B2

(12) United States Patent
Horne et al.

(10) Patent No.: US 10,032,328 B2
(45) Date of Patent: Jul. 24, 2018

(54) NON-INTRUSIVE DIAL ROTATION DETECTION OF HIGH SECURITY LOCKS

(71) Applicant: Sargent & Greenleaf, Inc., Nicholasville, KY (US)

(72) Inventors: George Marshall Horne, Lexington, KY (US); Michael Robert Clark, Lexington, KY (US)

(73) Assignee: Sargent & Greenleaf, Inc., Nicholasville, KY (US)

( * ) Notice: Subject to any disclaimer, the term of this patent is extended or adjusted under 35 U.S.C. 154(b) by 0 days.

(21) Appl. No.: 15/536,521

(22) PCT Filed: Dec. 15, 2015

(86) PCT No.: PCT/US2015/065731

§ 371 (c)(1),
(2) Date: Jun. 15, 2017

(87) PCT Pub. No.: WO2016/100289

PCT Pub. Date: Jun. 23, 2016

(65) Prior Publication Data

US 2017/0365121 A1 Dec. 21, 2017

Related U.S. Application Data

(60) Provisional application No. 62/091,940, filed on Dec. 15, 2014.

(51) Int. Cl.

| | |
|---|---|
| ***G07C 9/00*** | (2006.01) |
| ***E05B 39/00*** | (2006.01) |
| ***E05B 45/06*** | (2006.01) |
| *E05B 65/00* | (2006.01) |

(52) U.S. Cl.
CPC ..... *G07C 9/00722* (2013.01); *E05B 39/00* (2013.01); *E05B 45/061* (2013.01); *G07C 9/00666* (2013.01); *E05B 65/0075* (2013.01); *E05B 2045/0635* (2013.01); *E05B 2045/0665* (2013.01); *G07C 9/00912* (2013.01)

(58) Field of Classification Search
CPC ..... G07C 9/00722; G07C 9/00666; G07C 9/00912
USPC ..... 340/5.5–5.55
See application file for complete search history.

(56) References Cited

U.S. PATENT DOCUMENTS

| | | | | |
|---|---|---|---|---|
| 5,517,184 A * | 5/1996 | Miller | E05B 37/00 340/5.28 |
| 2009/0102653 A1* | 4/2009 | McGinnis | E05B 45/06 340/551 |
| 2014/0265359 A1* | 9/2014 | Cheng | E05B 47/026 292/144 |

* cited by examiner

*Primary Examiner* — Allen T Cao
(74) *Attorney, Agent, or Firm* — Caeden Drayton; Adan Ayala

(57) ABSTRACT

A rotation detection system for detecting the rotation of a lock dial includes a magnet coupled to the lock dial to generate a changing magnetic field in response to rotation of the lock dial, a sensor disposed near enough to the magnet to detect the magnetic field and provide a sensor output signal indicative of the magnetic field, and a controller coupled to the sensor for receiving the sensor output signal, the controller providing a controller output signal in response to a change in the sensor output signal. An alarm interface can receive the controller output signal and provide an alarm signal.

15 Claims, 6 Drawing Sheets

NON-INTRUSIVE DIAL ROTATION DETECTION OF HIGH SECURITY LOCKS

The present invention relates to high security locks and particularly to the detection of rotation of dial of a combination lock. More particularly, it relates to the non-intrusive detection of the dial rotation.

BACKGROUND OF THE INVENTION

In some applications of high security locks, particularly applications of locks that meet the Federal Standard FF-L-2740, it is desirable to detect when someone is operating the lock. The detection means can be interfaced with monitoring and alarm systems to verify if the lock operation is authorized. It is also desirable in most applications, again particularly applications of locks that meet the Federal Standard FF-L-2740, that the detection means are non-intrusive to the lock system, including the lock body mounted in the container interior and the lock dial mounted on the container door. This ensures that the detection means has not compromised any security feature of the lock system required by FF-L-2740. This invention achieves those goals and others.

SUMMARY OF THE INVENTION

The present invention detects the dial rotation of high security locks meeting the FF-L-2740 standard, like the Sargent & Greenleaf lock models 2740A and 2740B and the Kaba X-09, by detecting a changing magnetic field in close proximity to the lock body mounted in the interior of the secured container. These locks utilize permanent magnets inside the lock body that rotate when the dial is rotated to enter a combination to open the lock. The lock cases are constructed of Zamac, a non-ferrous metal that does not inhibit the magnetic flux path. As the dial is rotated, a changing magnetic field is present at a fixed position outside the lock body. Therefore a detection circuit mounted at a fixed position can detect this changing magnetic field to detect dial rotation.

DETAILED DESCRIPTION OF THE DRAWINGS

Figure 1:
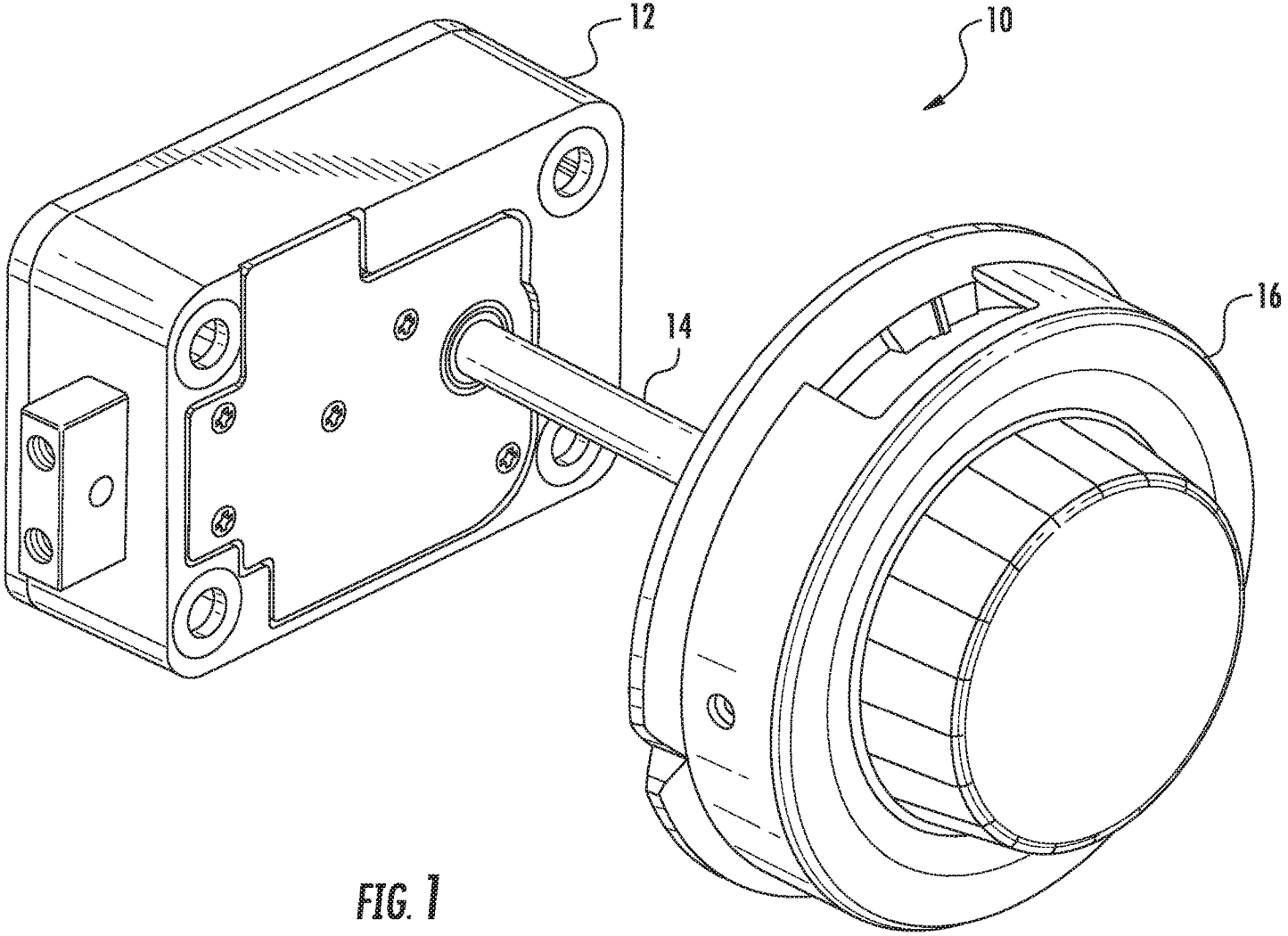
FIG. 1 illustrates an exemplary high security lock coupled to a dial.
Figure 2:
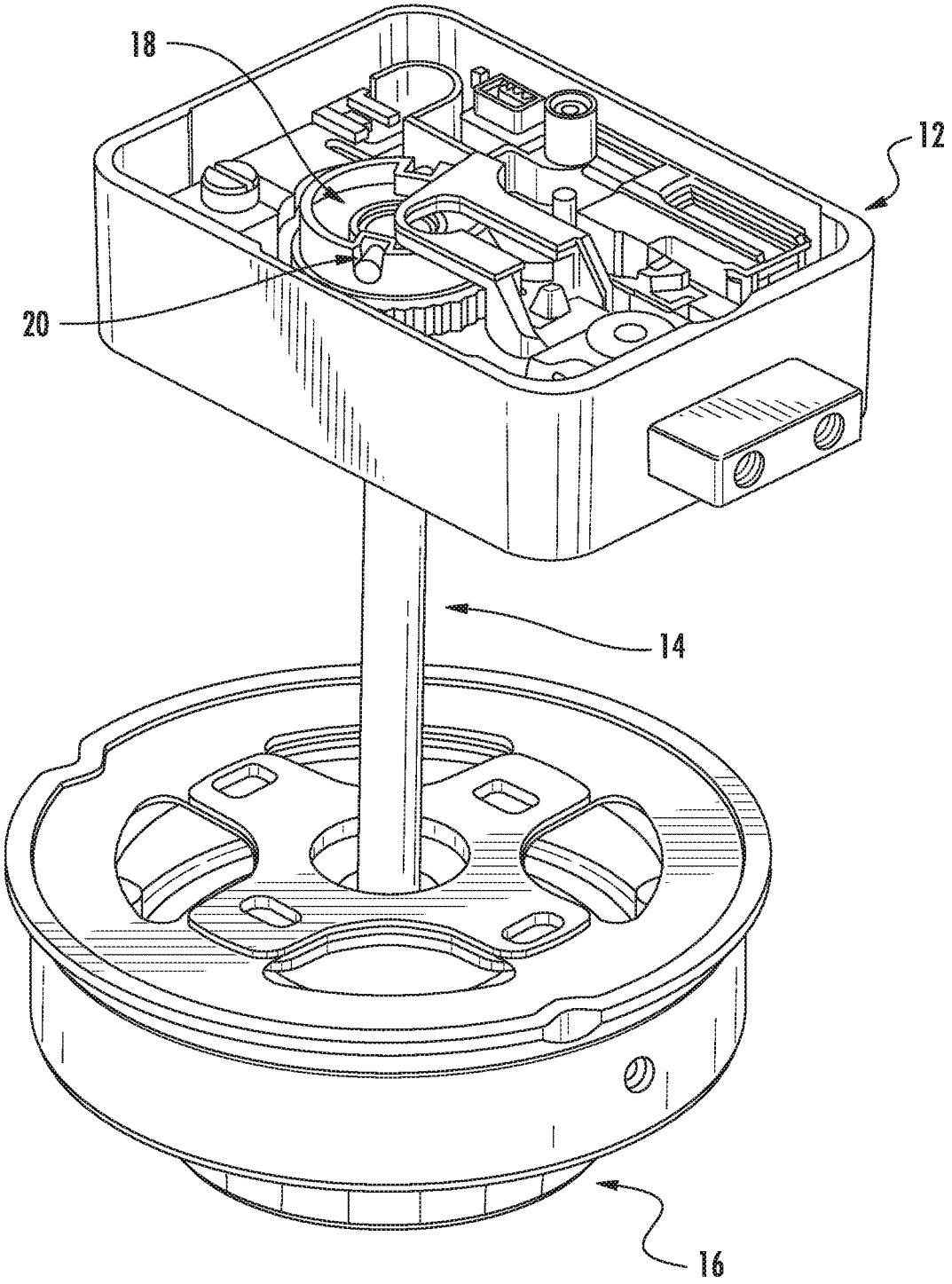
FIG. 2 is another view of the lock of FIG. 1 illustrating some of the internal components.

An exemplary high security lock 10 for use with the present invention is illustrated in FIGS. 1 and 2. The lock 10 includes a lock body 12 and a spindle 14 connected to a combination dial 16 through a door or drawer face 21 blocking access to a secure space. A cam 18 is disposed in the lock body 12 and is connected to the spindle 14 for rotation therewith. The cam 18 includes a magnet 20 mounted thereon such that rotation of the dial 16 rotates the magnet 20 about the axis of the spindle 14.

Figure 3:
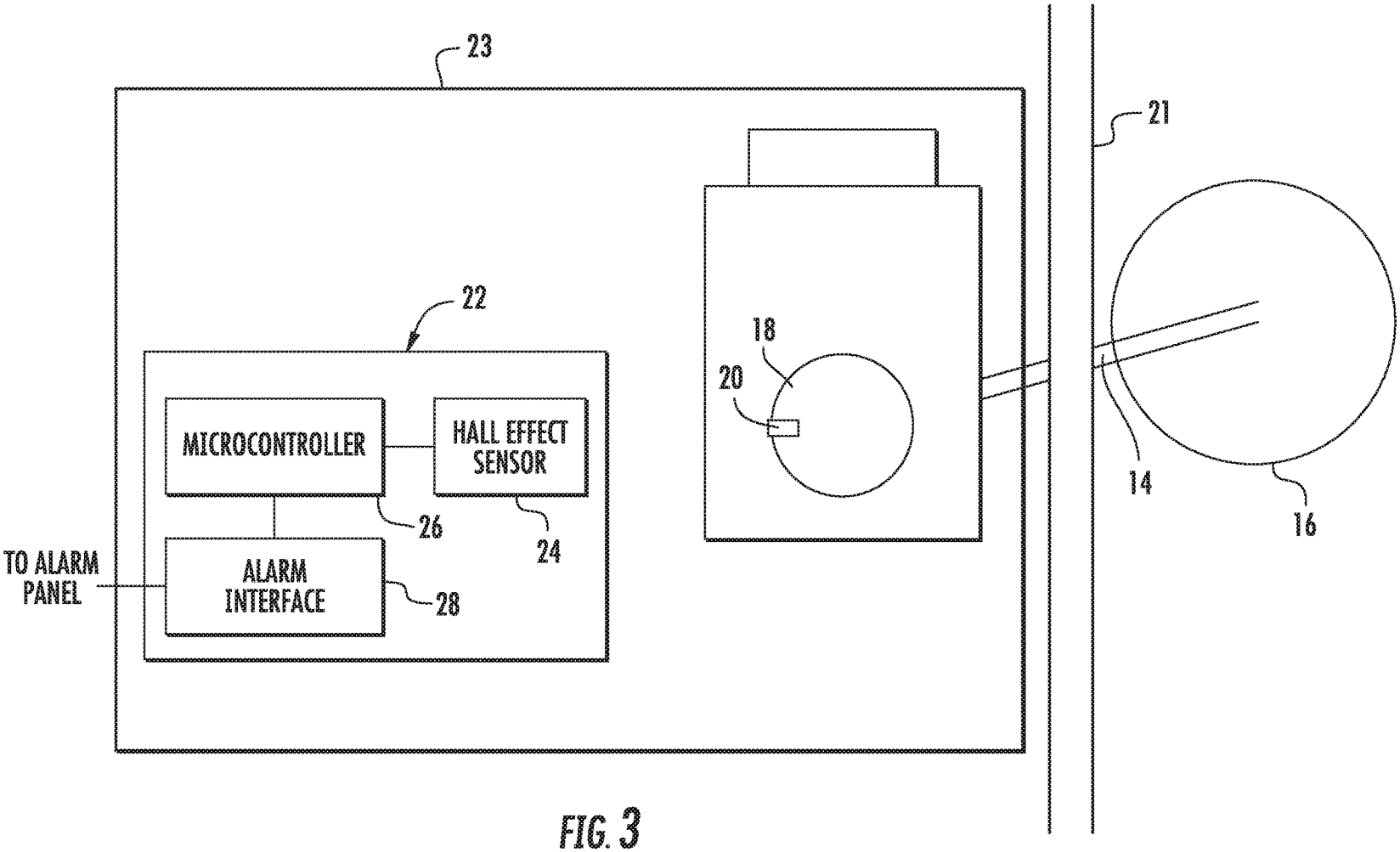
FIG. 3 is a block diagram of an exemplary rotation detector according to the present invention.
Figure 4:
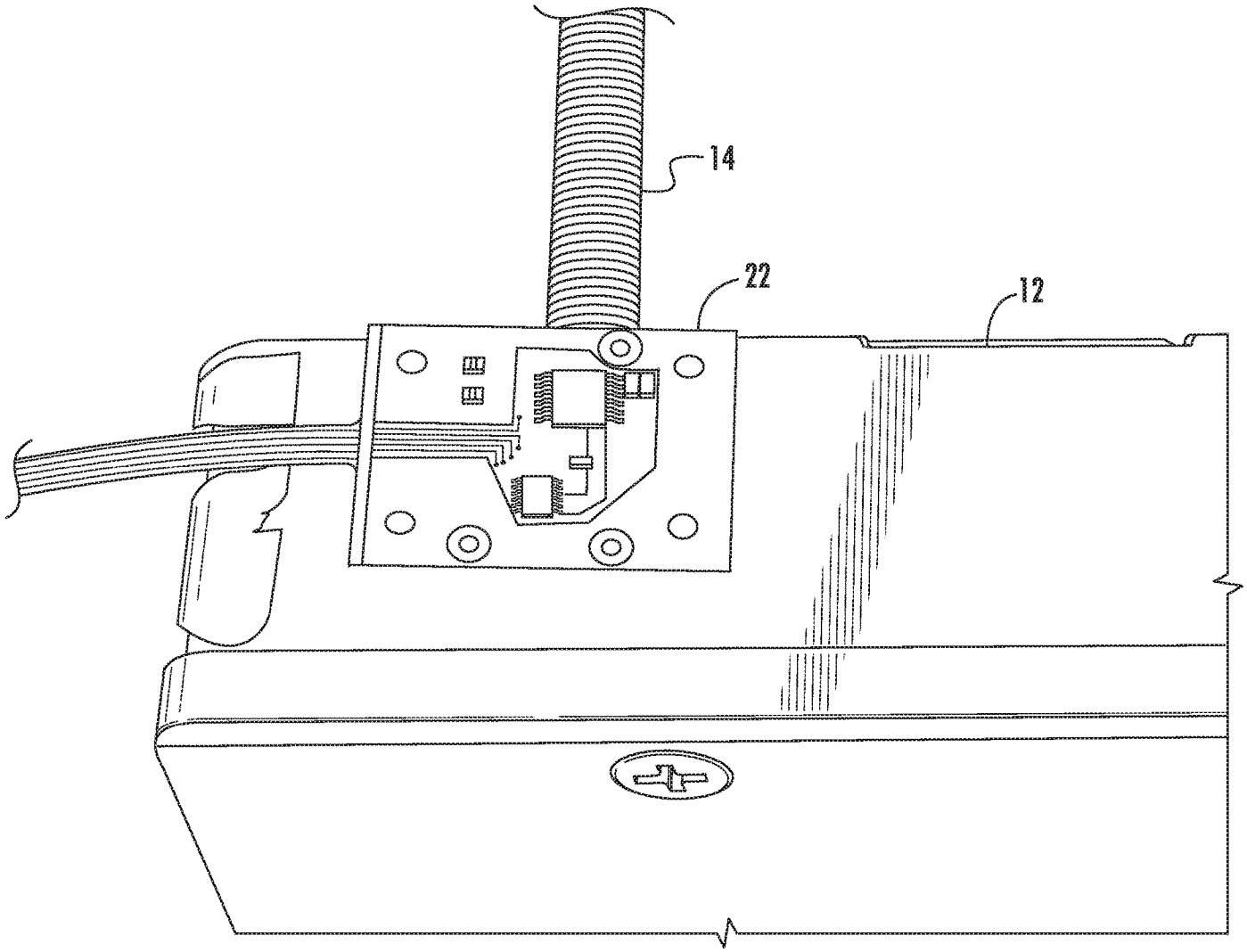
FIG. 4 illustrates a rotation detector mounted on the lock body.

A magnetic rotation detector (MRD) 22, illustrated in FIGS. 3 and 4, is mounted in a fixed position in close proximity to the lock body 12. The preferred location is in a position on the lock body 12 closest to the magnet or magnets internal to the lock body so the strongest magnetic field is presented to the circuit. However, it is not necessary to mount the MRD 22 directly on the lock body 12. Depending on the strength of the magnet 20 used in the lock 10 and the particular sensor selected, the MRD 22 can be mounted wherever there is space in close proximity to the lock body 12.

In typical high security lock applications, the lock body 12 is mounted inside a lock box 23 inside the container. The lock box 23 is a part of the container, typically constructed of hardened steel, to protect the lock from attacks through the walls of the container. Because of the ferrous metal used in the lock box, the MRD 22 should be mounted inside the box 23, typically on one of the lock body 12 surfaces. In any case, whether or not the lock body is positioned inside a lock box, the primary consideration is positioning the sensor near enough to the magnet in the lock to detect the rotation of the magnetic field and provide a sensor output signal indicative of the magnetic field.

The MRD 22 consists primarily of a linear Hall-effect sensor 24 connected to a microcontroller 26. The firmware running in the microcontroller 26 performs three primary functions:

- Auto-calibrate to the magnetic field for a resting dial position,
- Detect the dial rotation, and
- Produce an output signal when rotation is detected.

As is known in the art, A Hall effect sensor is a transducer that varies its output voltage in response to a magnetic field. The Hall-effect sensor 24 in the presently preferred embodiment is a linear type with an analog signal output level depending on the magnetic field present. A presently preferred embodiment uses the A1395 from Allegro MicroSystems LLC. It is the highest sensitivity part in the A139X series providing an output of 10 mV/G (millivolt/Gauss). At 0 Gauss, the output of the sensor is midway between the power supply rails (i.e., ~1.5 VDC when powered from 3 VDC). As the magnetic field goes negative the output decreases toward 0 VDC and as it goes positive the output increases toward the positive supply rail. In presently preferred embodiment, the magnetic field can be ~+−150 Gauss before the sensor output saturates at the positive or negative supply rail.

Figure 5:
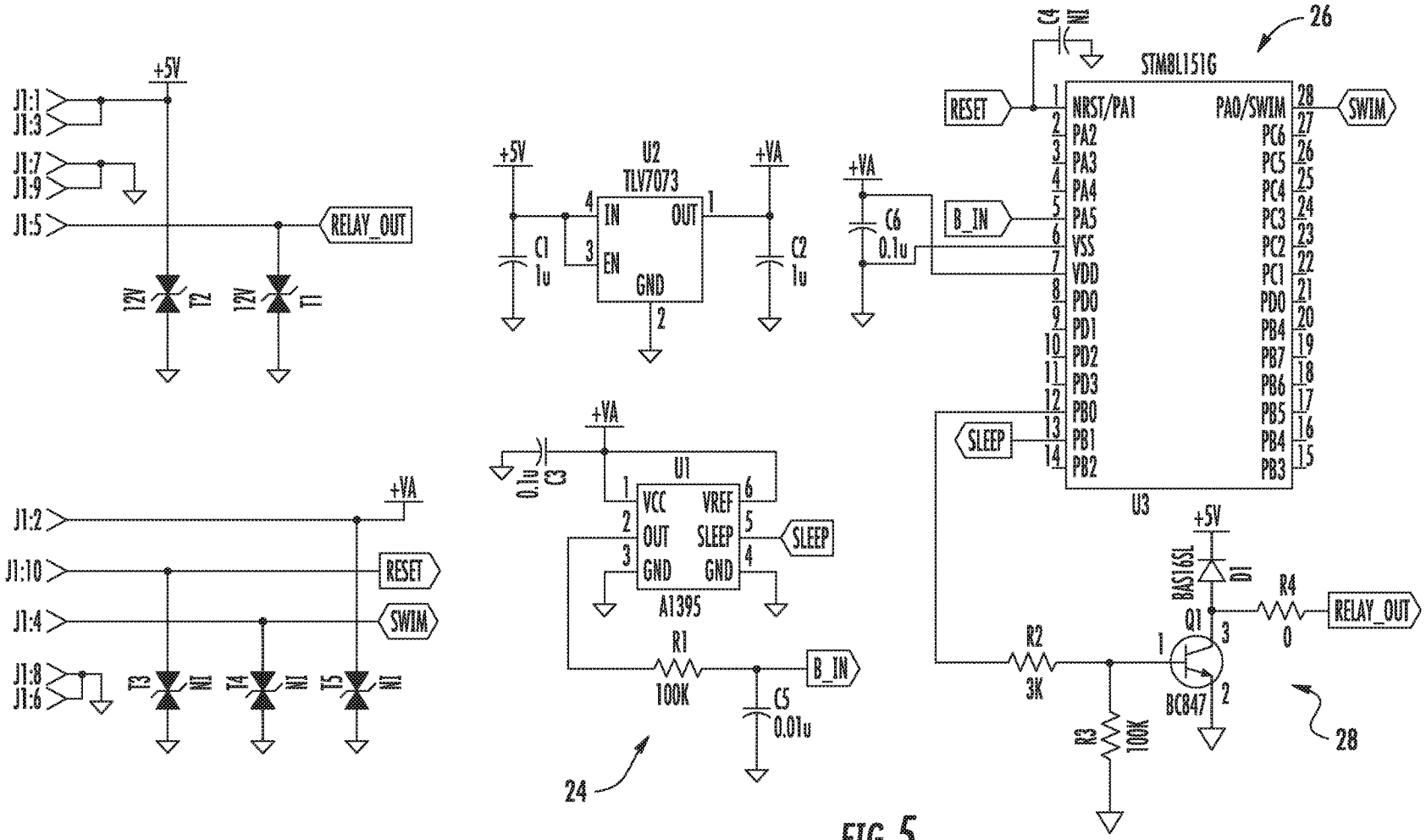
FIG. 5 is a wiring diagram for an exemplary rotation detector.

A preferred circuit is illustrated in the wiring diagram of FIG. 5. The Relay Out signal from the circuit is an Open Collector output that provides a ground sink when rotation is detected. The output of the Hall-effect sensor 24 is the input to an analog-to-digital converter (ADC) in the microcontroller 26. The microcontroller 26 can output a signal to an alarm interface or monitoring system 28 or to an access history file.

The presently preferred microcontroller is the STMicroelectronics STM8L151G. In the presently preferred embodiment, the resolution of the ADC of the selected microcontroller 26 is 12-bits, or ~0.73 mV per bit, or ~0.07 Gauss per bit. The microcontroller 26 continuously samples the ADC to monitor the magnetic field.

Figure 6:
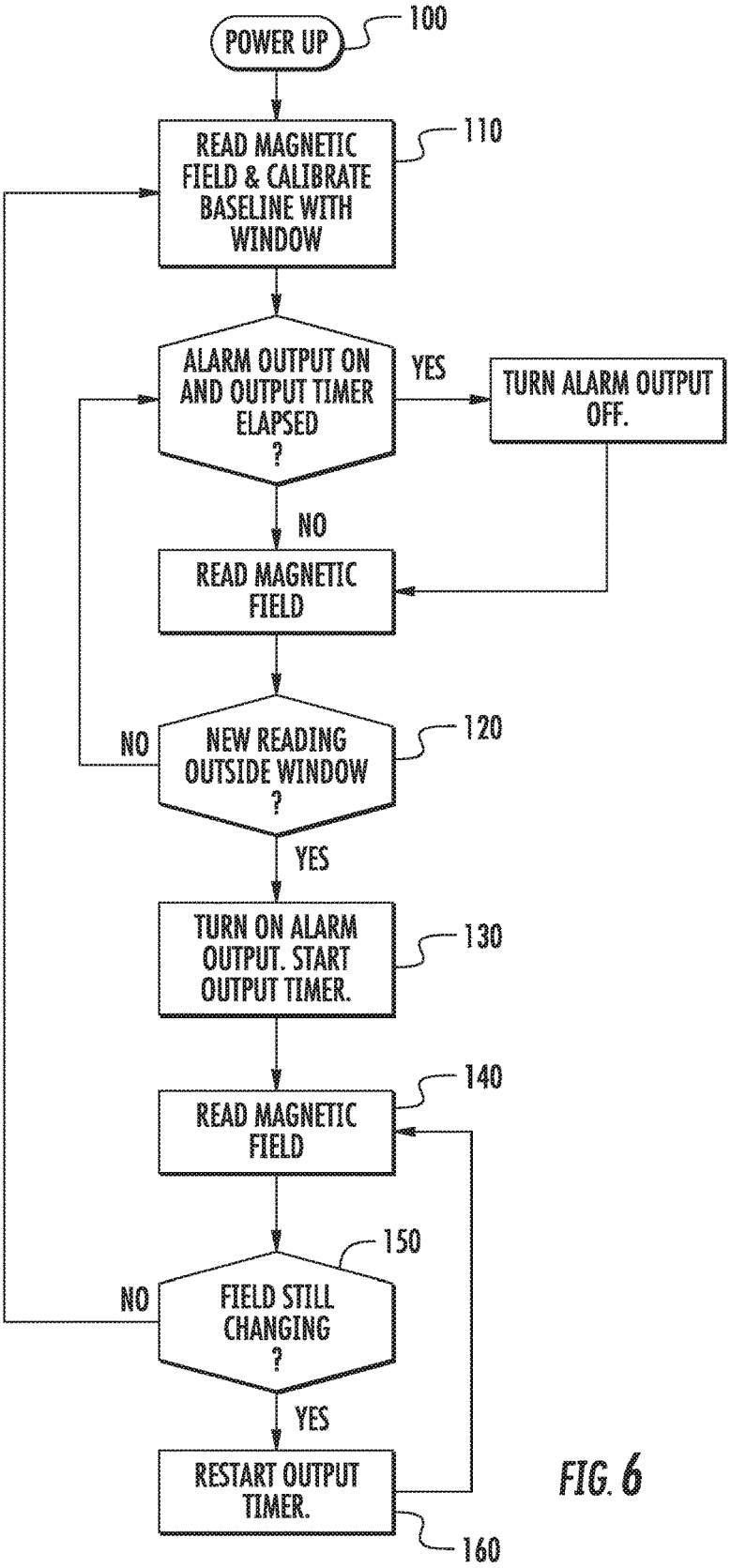
FIG. 6 is a flow diagram for detecting rotation of a dial.

When the MRD 22 is first powered on, step 100 in FIG. 6, it must establish a baseline average magnetic field, step 110. When the dial 16 is stationary, the magnetic field at the MRD 22 is a relatively constant value, positive or negative. The MRD 22 takes numerous samples and if all the samples are within a set window value the baseline is set. This baseline is then used as the comparison point to determine if the dial 16 is rotating. Once all the samples are settled so the highest and lowest samples are not more than 5G apart, the baseline is set to the average of the sampled values. The MRD 22 therefore auto-calibrates to the resting position of the dial 16.

If some samples fall outside this window, the MRD 22 assumes the dial 16 is rotating and the baseline is not set until the samples fall within the window. Once the baseline is established, the MRD 22 continues to monitor the magnetic field, as at step 120, and will activate an output, which can interface to an alarm or monitoring system 28 as at step 130, if the average magnetic field falls outside the set window (~+/−2.5G in a presently preferred embodiment). The microcontroller 26 continues to monitor the magnetic field at steps 140, 150 and 160. The output stays activated for a set period of time. In a presently preferred embodiment, the output stays active for 10 seconds after the magnetic field has settled to a stationary value. This time allows the MRD 22 to auto-calibrate to a new stationary value and be set for another dial rotation before the output de-activates.

For best results, the magnetic field at the mounting position of the MRD 22 should change more than the set window value when the dial 16 is rotated a small amount and should not go beyond the saturation level of the Hall-effect sensor 24 at any dial position. In presently preferred embodiment, when the MRD 22 is mounted on the rear of a Sargent & Greenleaf Model 2740B lock body, the typical magnetic flux will vary 20G (roughly +10 to −10G, well under the saturation level) over ½ dial rotation (180 degrees). The set window of ~+/−2.5G allows the rotation to be detected when the dial is rotated 10 numbers or less out of 100 numbers around the dial 16. Normal operation of the S&G 2740 locks require the dial to be rotated several complete revolutions prior to entering the opening combination, so the MRD 22 will detect rotation at the very beginning of an attempted combination entry.

In some applications of the MRD 22, there are concerns with attacks to prevent the MRD 22 from notifying the alarm or monitoring system 28 of the dial rotation. One probable attack method is to apply a very strong magnet outside the container such that the field can interfere with the MRD 22 operation. In this case, there are several factors and one additional feature of the MRD 22 to thwart such an attack.

- The magnetic field must penetrate through (and not be trapped in) the safe and lock box steel.
- The magnetic field must be strong enough to have sufficient strength at the distance of the rotation detection circuit from the outside of the safe. The field drops off quickly with distance.
- If the external field is sufficiently strong to overcome the first two obstacles, it will trigger the MRD 22 as it is applied.
- After the initial trigger, the external field must be strong enough to saturate the Hall-Effect sensor 24. Otherwise, the circuit will auto-calibrate to the new level and still signal a rotation of the dial 16.
- If the external field remains strong enough to saturate the Hall-Effect sensor 24, the MRD 22 will maintain the output in the active state to notify the monitoring system 28 of a potential attack, or other inoperability issue with the MRD 22.

To assist in field applications of the MRD 22, a LED or second output (not shown) can provide a signal to indicate when the magnetic field is within the proper range of the sensor 24. For example, the LED or second output can be activated when the field is just outside the set window and well within the saturation limits. In many applications, as the dial 16 is turned, the field present at the MRD 22 will range from a negative value to zero to a positive value. If the field is within an appropriate range, the LED or second output will be active for most of the dial rotation. It will de-activate when the field drops below the set window around 0G. As long as the output remains active for most of the rotation of the dial 16 and the alarm output activates when the dial 16 is turned a short distance, the MRD 22 is mounted in an acceptable location.

In some applications, the field may never go to zero and the LED or second output will remain active throughout the dial rotation. This too indicates the MRD 22 is mounted in an acceptable location as long as the alarm output activates when the dial 16 is turned a short distance.

However, if the LED or second output remains inactive throughout the dial rotation, then the magnetic field is either too weak or too strong for proper operation.

If the LED or second output is inactive during most of the dial rotation, then the MRD 22 is on the border line of acceptable operation and some adjustment of the mounting location should be considered.

- The MRD detects dial rotation non-intrusively for locks already incorporating magnets in the lock body that rotate with the dial. Since the lock case does not have to be opened, there is no question that the lock security has been compromised or the manufacturer's warranty has been voided.
- The MRD can be easily installed after the lock has been installed. Since the MRD does not have to attach to a rotating member such as the shaft between the lock and the dial, it is easily installed after lock installation. This makes it easy to retrofit the MRD into existing lock installations.
- The MRD auto-calibrates to the magnetic field. This allows the MRD to be mounted in a convenient location inside the lock box in close proximity to the lock box. It also allows the MRD to easily operate with other locks; not just the S&G 2740 model locks.
- The MRD maintains an active alarm output if the sensor is saturated. This alerts the customer if a) someone is trying to compromise the MRD operation with a strong external magnet or b) there is some other issue preventing the proper operation of the MRD.
- The MRD includes a LED or second output to aide in installations by indicating when the magnetic field is in an acceptable range for proper operation.

Although the present invention was primarily targeted to FF-L-2740 applications, it can also be used in applications with other high security locks like mechanical locks that utilize a rotating dial to enter the combination.

The invention claimed is:

1. A rotation detection system for detecting the rotation of a lock dial, the system comprising:

a magnet coupled to the lock dial and adapted to generate a changing magnetic field in response to rotation of the lock dial;

a mountable detector for detecting the magnetic field generated by the magnet and providing an output signal to a monitoring system in response to a change in the detected magnetic field.

2. The system of claim 1 wherein the detector includes a magnetic rotation detector, the magnetic rotation detector including a transducer that varies its output in response to a magnetic field.

3. The system of claim 2 wherein the detector further includes a controller coupled to the tranducer for receiving the tranducer output.

4. The system of claim 3 further including an alarm interface coupled to the detector for receiving an output signal from the controller and providing an alarm signal in response to the controller output signal.

5. The system of claim 1 wherein the detector includes a Hall effect sensor.

6. A rotation detection system for detecting the rotation of a lock dial, the system comprising:

a rotating lock dial coupled to a lock body by a spindle;

a magnet for providing a magnetic field, the magnet being disposed in the lock body and coupled to the lock dial for rotation therewith, the magnetic field changing as the magnet moves in response to the rotation of the lock dial;

a sensor disposed near enough to the magnet to detect the magnetic field and provide a sensor output signal indicative of the magnetic field, the sensor output signal indicative of the magnetic field changing as the magnetic field changes;

a controller coupled to the sensor for receiving the sensor output signal indicative of the magnetic field, the controller providing a controller output signal in response to a change in the sensor output signal indicative of the magnetic field; and an alarm interface coupled to the controller for receiving the controller output signal.

7. The system of claim 6 wherein the sensor includes a Hall effect sensor.

8. A method of detecting the rotation of a lock dial comprising the steps of:

establishing a baseline magnetic field;

providing a magnet coupled to a lock dial, the magnet providing a changing magnetic field in response to rotation of the lock dial;

monitoring the magnetic field; and providing a magnetic rotation detector for detecting the magnetic field generated by the magnet and providing an output signal in response to a change in the detected magnetic field.

9. The method of claim 8 wherein the step of providing a magnetic rotation detector further includes the steps of providing a transducer that varies its output in response to a magnetic field.

10. The method of claim 9 wherein the step of providing a magnetic rotation detector further includes the steps of providing a controller coupled to the tranducer for receiving the tranducer output.

11. The method of claim 10 wherein the controller provides the output signal to an alarm interface.

12. The method of claim 10 further comprising the step of coupling the alarm interface to the controller for receiving the controller output signal and providing an alarm output signal in response to receiving the controller output signal.

13. The method of claim 8 further including the steps of providing a lock body having a cam coupled to the lock dial, the magnet being coupled to the cam for rotation with the lock dial.

14. The method of claim 8 further including sending the output signal to an alarm interface when it is determined the average magnetic field falls outside a predetermined range.

15. The system of claim 6, further including the controller sending the output signal to the alarm interface when it is determined the average magnetic field falls outside a predetermined range.

* * * * *